US006039007A

United States Patent [19]

Ban et al.

[11] Patent Number: 6,039,007

[45] Date of Patent: Mar. 21, 2000

[54] VISCOUS FLUID HEATER

[75] Inventors: Takashi Ban; Tatsuyuki Hoshino; Takanori Okabe; Takahisa Ban, all of Kariya, Japan

[73] Assignee: Kabushiki Kaisha Toyoda Jidoshokki Seisakusho, Aichi-ken, Japan

[21] Appl. No.: 09/224,909

[22] Filed: Jan. 4, 1999

[30] Foreign Application Priority Data

Jan. 28, 1998 [JP] Japan ..... 10-015622

[51] Int. Cl.[7] ..... F22B 3/06

[52] U.S. Cl. ..... 122/26; 126/247; 237/12.3 R

[58] Field of Search ..... 122/26; 126/247; 237/12.3 B, 12.3 R; 123/142.5 R

[56] References Cited

U.S. PATENT DOCUMENTS 5,816,236 10/1998 Moroi et al. ..... 126/247

5,871,149 2/1999 Moroi et al. ..... 122/26

5,971,291 10/1999 Moroi et al. ..... 237/12.3 R

*Primary Examiner*—Teresa Walberg

*Assistant Examiner*—Gregory A. Wilson

*Attorney, Agent, or Firm*—Morgan & Finnegan, L.L.P.

[57] ABSTRACT

In the heater of the present invention, a heating chamber accommodates a viscous fluid. A rotor is located in the heating chamber. The rotor rotates and shears the viscous fluid to generate heat. The heat generated in the heating chamber is transferred to the heat exchanger and heats a fluid that flows through the heat exchanger. A reservoir stores the viscous fluid. The reservoir has an upper portion and a lower portion, and the lower portion has a greater volume than the upper position. A return passage connects the heating chamber to the reservoir so that the viscous fluid moves from the heating chamber to the reservoir when the rotor rotates. A supply passage connects the reservoir to the heating chamber so that the viscous fluid flows from the reservoir to the heating chamber.

18 Claims, 9 Drawing Sheets rotor rotation direction
controller
sensors
heater switch
temperature adjuster
50
51
52a
52b
1
1b
3
5a
6
6d
7
10
13
20
20a
20b
21
21a
21b
23
24
30
31
32
33
34
35
40
41
42
43
44
45
X

VISCOUS FLUID HEATER

BACKGROUND OF THE INVENTION

The present invention relates to a heater for vehicles. More specifically, the present invention pertains to a heater that has a rotor and viscous fluid in its housing and generates heat by the rotor rotation shearing the viscous fluid. The heat generated by the rotor is transferred to another fluid such as a coolant that circulates through the housing.

A heater using the drive force of a vehicle engine is described, for example, in a German Unexamined Patent Publication No. 3832966. The heater will now be described with reference to FIG. 9. The heater has a housing 71 including a heating chamber 72 and a ring-shaped water jacket 73 around the heating chamber 72. An annular housing 87 is provided between the heating chamber 72 and the water jacket 73. A reservoir 74 is located adjacent to the heating chamber 72 in the housing 71. Engine coolant flows into the water jacket 73 through an inlet passage 88 and then flows to a heat exchanger of the vehicle through an outlet passage 89. A certain amount of viscous fluid 79 is charged in the heating chamber 72 and the reservoir 74. The viscous fluid occupies about half the volume of the reservoir 74.

A middle wall 75 separates the heating chamber 72 and the reservoir 74. The middle wall 75 has a supply passage 83 for supplying the viscous fluid 79 from the reservoir 74 to the heating chamber 72. A partition wall 75 has a return passage 84 for returning the viscous fluid 79 from the heating chamber 72 to the reservoir 74. The supply passage 83 is opened and closed by a lever 86 that has a bimetal plate spring 85. This adjusts the supply amount of the viscous fluid 79 to the heating chamber 72, thus adjusting the level of heat generation.

A drive shaft 76 is rotatably supported in the rear of the housing 71. A rotor 77 is rigidly attached to one end of the drive shaft 76 to integrally rotate with the drive shaft 76. A pulley 78 is fixed to the other end of the drive shaft 76. The pulley 78 is connected to an engine (not shown) by a belt.

When the engine rotates the rotor 77, the viscous fluid is sheared between an inner surface 81 of the heating chamber 72 and a shearing surface 80 of the rotor 77. This generates heat. The heat generated in the heating chamber 72 is transferred through the partition wall 87 to the coolant flowing in the water jacket 73. Then, the coolant is supplied to a heat exchanger of the vehicle for warming the passenger compartment.

When the viscous fluid is relatively cool, the bimetal plate spring 85 does not press the lever 86 to the supply passage 83. Accordingly, the supply passage remains open, permitting the supply of the viscous fluid 79 from the reservoir 74 to the heating chamber 72.

In such heaters, it is important to reduce the torque load on the rotor 77 when the rotor 77 first starts to rotate. When the engine stops during the operation of the heater, the rotor 77 stops and the return of the viscous fluid from the heating chamber 72 to the reservoir 74 is stopped. Therefore, a substantial amount of the viscous fluid 79 remains in the heating chamber 72.

When the rotor 77 starts to rotate again, the remaining viscous fluid 79 applies a significant torque load to the rotor 77. In other words, a great torque load is applied to the engine through the rotor 77 and the belt. This causes noise, torque shock, slippage of the belt, and wear on the parts of the heater. Also, since the viscous fluid 79 occupies about half the volume of the reservoir 74, the viscous fluid 79 is likely to be oxidized by the air in the reservoir 74. This deteriorates the quality of the viscous fluid 79 and heat generating capacity of the heater.

SUMMARY OF THE INVENTION

The first objective of the present invention is to ease the starting of the rotor rotation of vehicle heaters. The second objective of the present invention is to prevent the deterioration of viscous fluid of vehicle heaters.

To achieve the above objectives, the heater of the present invention will have the following elements. A heating chamber accommodates a viscous fluid. A rotor is located in the heating chamber. The rotor rotates and shears the viscous fluid to generate heat. The heat generated in the heating chamber is transferred to the heat exchanger and heats a fluid that flows through the heat exchanger. A reservoir stores the viscous fluid. The reservoir has an upper portion and a lower portion, and the lower portion has a greater volume than the upper portion. A return passage connects the heating chamber to the reservoir so that the viscous fluid moves from the heating chamber to the reservoir when the rotor rotates. A supply passage connects the reservoir to the heating chamber so that the viscous fluid flows from the reservoir to the heating chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

Figure 1:
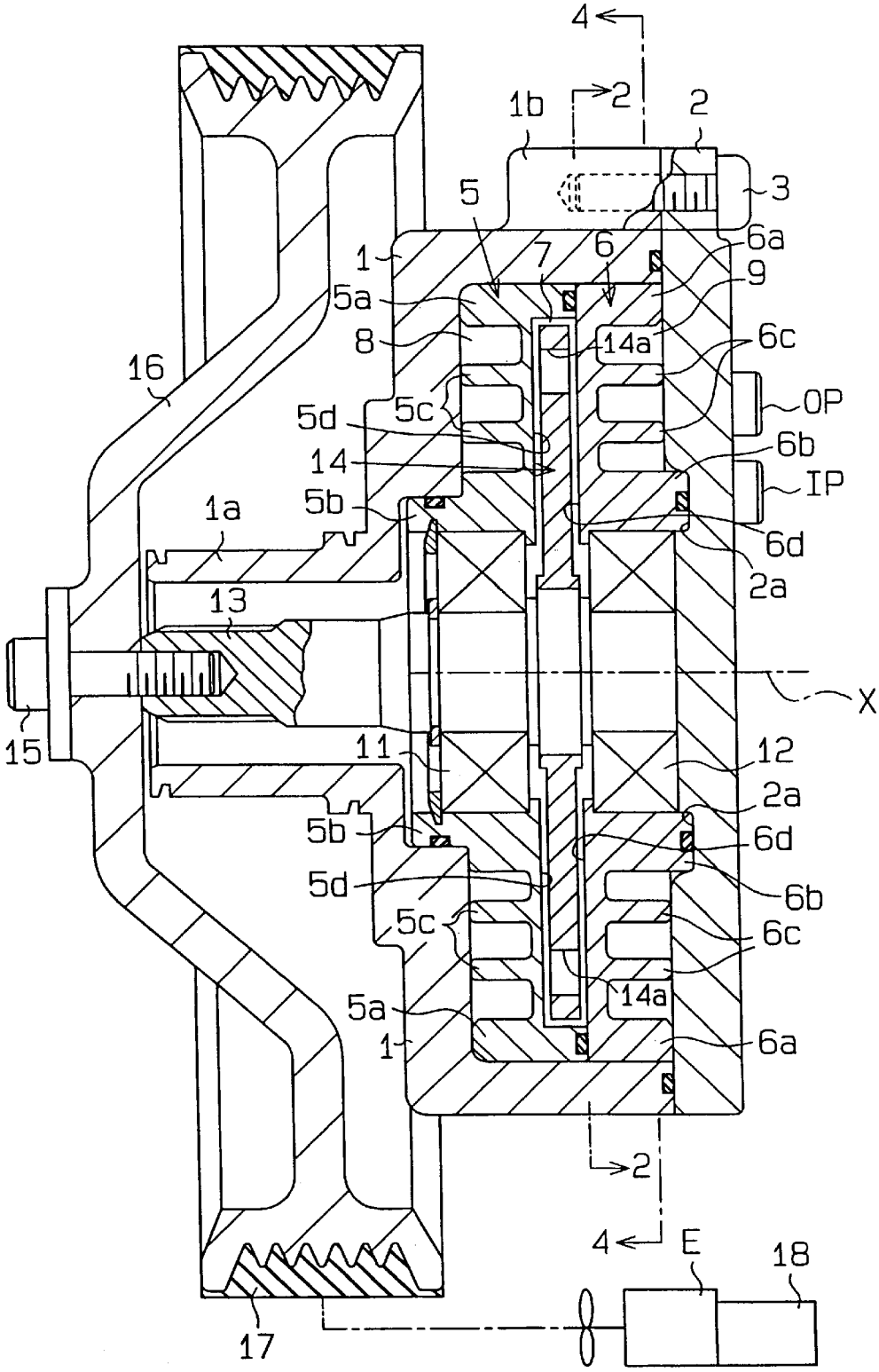
FIG. 1 is a cross-sectional view of a vehicle heater according to a first embodiment of the present invention.

A first embodiment of the present invention will now be described with reference to FIGS. 1–6. As shown in FIG. 1, a heater has a front housing part 1 and a rear housing part 2. The front housing part includes a bowl-shaped portion 1*b* and a hollow cylindrical boss 1*a*, which extends forward (leftward in FIG. 1) from the cylindrical bowl 1*b*. The rear housing part 2, which is generally flat, covers the rear opening of the bowl-shaped portion 1*b*. The front housing part 1 and the rear housing part 2 are bolted together by bolts 3 (See FIG. 2), with a front partition plate 5 and a rear partition plate accommodated inside.

The front partition plate 5 and the rear partition plate 6 each have annular rims 5*a*, 6*a*. The rims 5*a*, 6*a* tightly contacts each other and the inner walls of both housing parts 1, 2. This immobilizes the partition plates 5, 6 inside the housings 1, 2. The first partition plate 5 has a recess 5*d*. A heating chamber 7 is formed between the partition plates S and 6. The recess 5*d* of the front partition plate 5 and a front surface 6*d* of the rear partition plate 6 define the heating chamber 7. The front and rear housing parts 1, 2 and the front and rear partition plates 5, 6 are made of aluminum or an aluminum alloy.

The front partition plate 5 includes a boss 5*b* and guide fins 5*c*. The boss 5*b* conforms to the inner shape of the middle section of the front housing part 1. The guide fins 5*c* are concentrically formed around the boss 5*b*. The front partition plate is fitted in the front housing part 1 so that the boss 5*b* closely contacts the inner surface of the front housing part 1. As a result, a front water jacket 8, which serves as a front heat exchanger adjacent to the heating chamber 7, is formed between the inner surface of the front housing part 1 and the front partition plate 5. The rim 5*a*, the boss 5*b*, and the guide fins 5*c* guide liquid coolant flowing in the water jacket 8.

Figure 4:
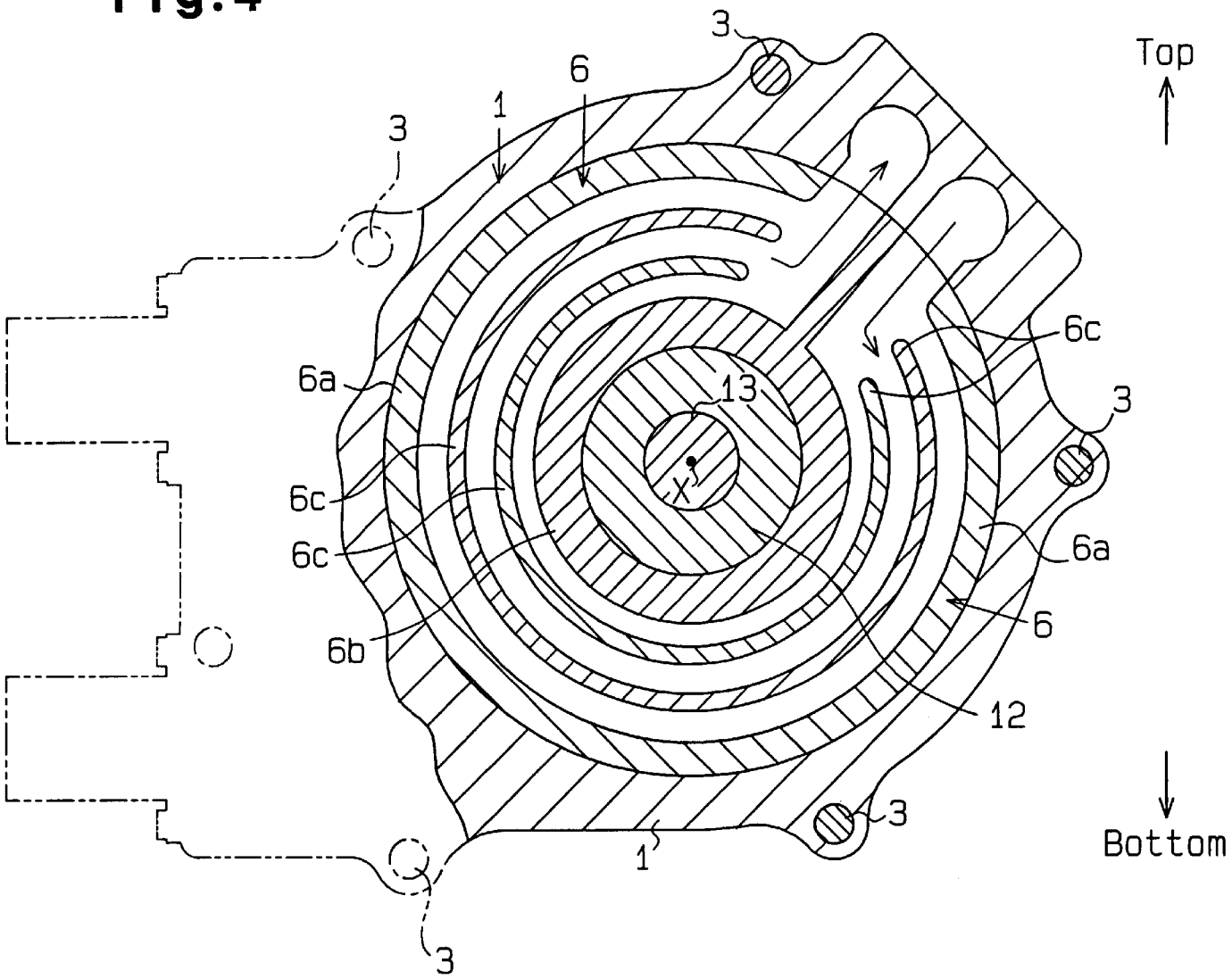
FIG. 4 is a partial cross-sectional view taken on line 4—4 of FIG. 1.

As shown in FIGS. 1 and 4, the rear partition plate 6 includes a boss 6*b* and the guide fins 6*c*. The boss 6*b* is formed in the middle portion of the rear plate 6. The guide fins 6*c* are concentric with the boss 6*c*. The guide fins 5*c* of the front plate 5 have the same shape as the rear guide fins 6*c* of FIG. 4. When the front plate and the rear plate are fitted in the front housing part 1, the boss 6*b* of the rear plate 6 engages with an annular recess 2*a* of the rear housing part 2. Accordingly, a rear annular water jacket 9 is formed between the rear housing part 2 and the rear plate 6. The rear water jacket serves as a rear heat exchanger adjacent to the heating chamber 7. The rim 6*a*, the boss 6*b* and the guide fins 6*c* guide liquid engine coolant flowing in the rear water jacket 9.

As shown in FIG. 1, an inlet port IP and an outlet port OP are provided on the rear wall of the rear housing part 2. The coolant flows into the water jackets 8, 9 through the inlet port IP and flows out to a heating circuit (not shown) of the vehicle through the outlet port OP.

A drive shaft 13 is rotatably supported by the front housing part 1 and the front and rear plates 5, 6 through front and rear bearings 11, 12. The bearings 11, 12 have seals. The front bearing 11 is located between the inner surface of the boss 5*b* of the front plate 5 and the periphery of the drive shaft 13, sealing the heating chamber 7. Also, the rear bearing 12 is located between the inner surface of the boss 6*b* of the rear plate 6 and the periphery of the drive shaft 13, sealing the heating chamber 7.

In the heating chamber 7, a disk-shaped rotor 14 is fixed to the drive shaft 13 and rotates with the drive shaft 13. A space is formed between the surface of the rotor 14 and the inner walls 5*d*, 6*d* of the heating chamber 7. The space is formed, for example, within the range of several tens to several hundreds microns ($\mu$m). Through holes 14*a* are formed in the periphery of the rotor 14. The through holes 14*a* are arranged in a regular pattern and are equally spaced apart.

A pulley 16 is secured to the front end of the drive shaft 13 by a bolt 15. The pulley 16 is connected to the engine E of the vehicle by V belt 17. The engine E includes a starter motor 18.

Figure 2:
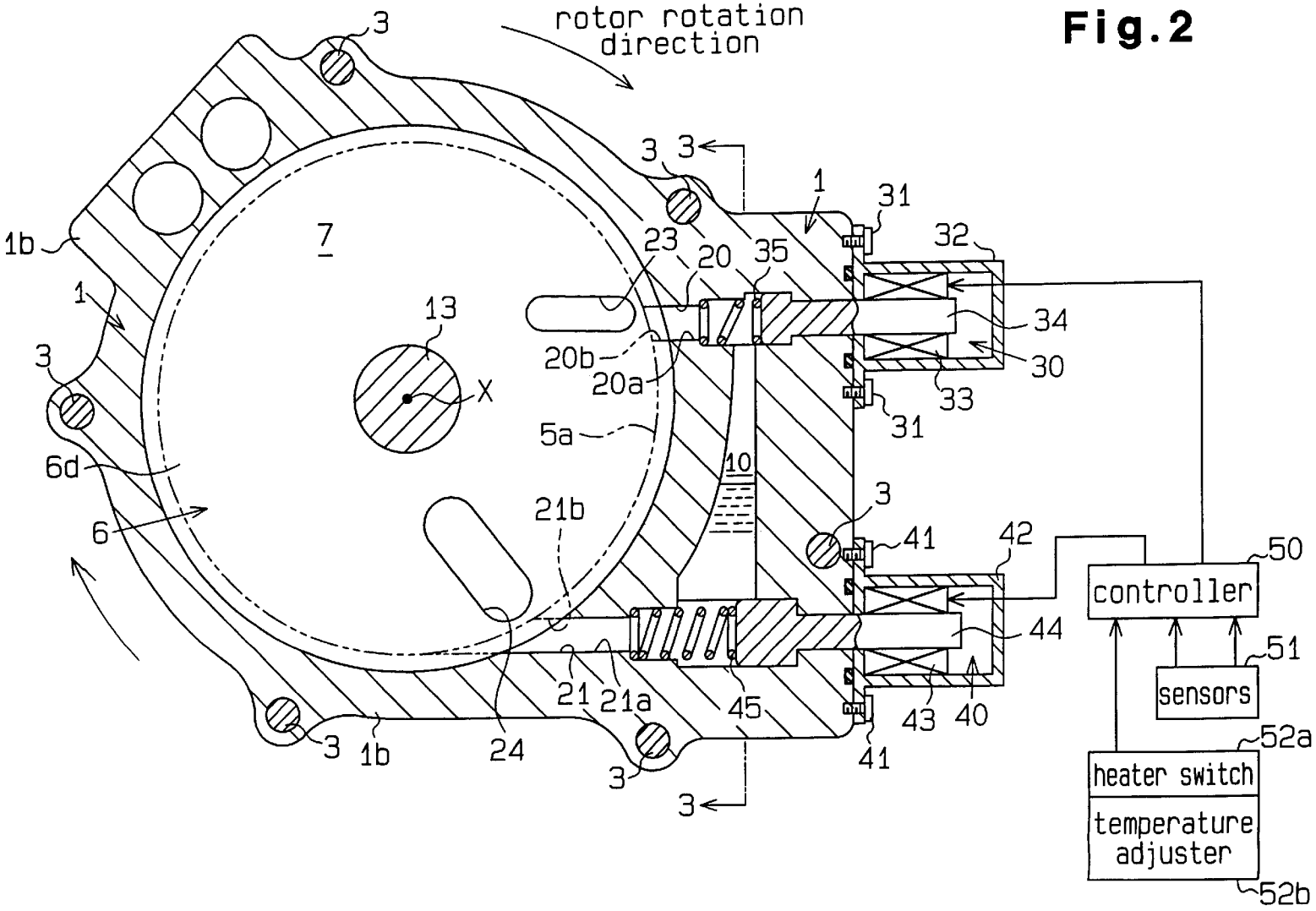
FIG. 2 is a cross-sectional view taken on line 2—2 of FIG. 1 when a return passage and a supply passage are open.
Figure 3:
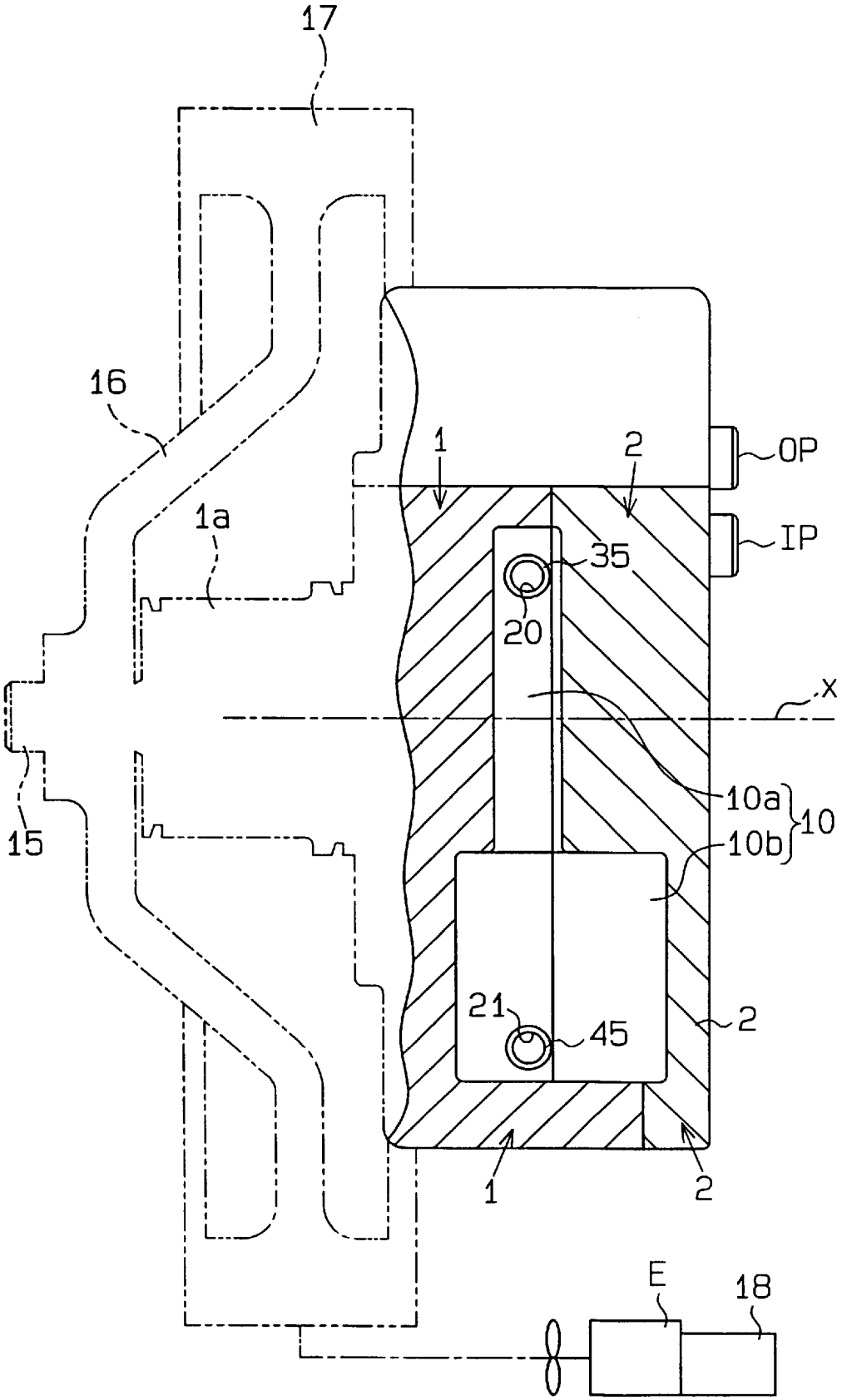
FIG. 3 is a partial cross-sectional view taken on line 3—3 of FIG. 2.

As shown in FIGS. 2 and 3, a reservoir 10 is provided outside of the heating chamber between the front housing part 1 and the rear housing part 2. The reservoir 10 is formed by covering a recessed portion of the front housing 1 with the rear housing part 2. As shown in FIG. 3, the reservoir chamber 10 includes an upper chamber 10*a* and a lower chamber 10*b*, which have different widths in the direction of the axis X of the drive shaft 13. As shown in FIG. 3, the upper chamber 10*a* is narrower than the lower chamber 10*b*.

The upper chamber 10*a* is formed as a passage having two to three times the width of the inner diameter of a return passage 20. The lower chamber 10*b*, in addition to being wider in the direction of the axis X, is tapered to be longer towards the bottom in a direction perpendicular to the axis X, as shown in FIG. 2. Accordingly, the volume of the lower chamber is substantially larger than that of the upper chamber 10*a*. The lower chamber 10*b* is located entirely below the axis X of the drive shaft 13.

As shown in FIGS. 2 and 3, a return passage 20 and a supply passage 21 are formed in the front housing part and in the partition plates 5, 6 to connect the heating chamber 7 to the reservoir 10. The return passage 20 and the supply passage 21 respectively include through holes 20*a*, 21*a*, which are formed in the front housing part 1, and through holes 20*b*, 21*b*, which are formed in the rims 5*a*, 6*a* of the plates 5, 6. The return passage 20 connects the heating chamber 7 to the upper chamber 10*a* of the reservoir 10. The supply passage 21 connects the lower chamber 10*b* of the reservoir 10 to the heating chamber 7.

The heating chamber 7 and the reservoir 10, which are connected by the return passage 20 and the supply passage 21, form a sealed space. A viscous fluid, preferably silicone oil is put in the sealed space. The viscous fluid should fill the lower chamber 10*b* of the reservoir 10. Accordingly, the return passage 20 is located above the surface of the viscous fluid of the reservoir chamber 10, and the supply passage 21 is located below the fluid surface.

A return groove 23 and a supply groove 24 are formed to extend generally from the middle portion to the periphery on the front surface 6*d* of the rear plate 6. One end of the return groove 23 is located near the entrance of the return passage 20. When the rotor 14 rotates, the return groove guides the flow of viscous fluid from the heating chamber 7 to the reservoir 10. The supply groove extends generally in the radial direction. One end of the supply groove 24 is located near the exit of the supply passage 21. When the rotor 14 rotates, the supply groove 24 guides the viscous fluid from the supply passage 21 to the middle area of the heating chamber 7.

Figure 5:
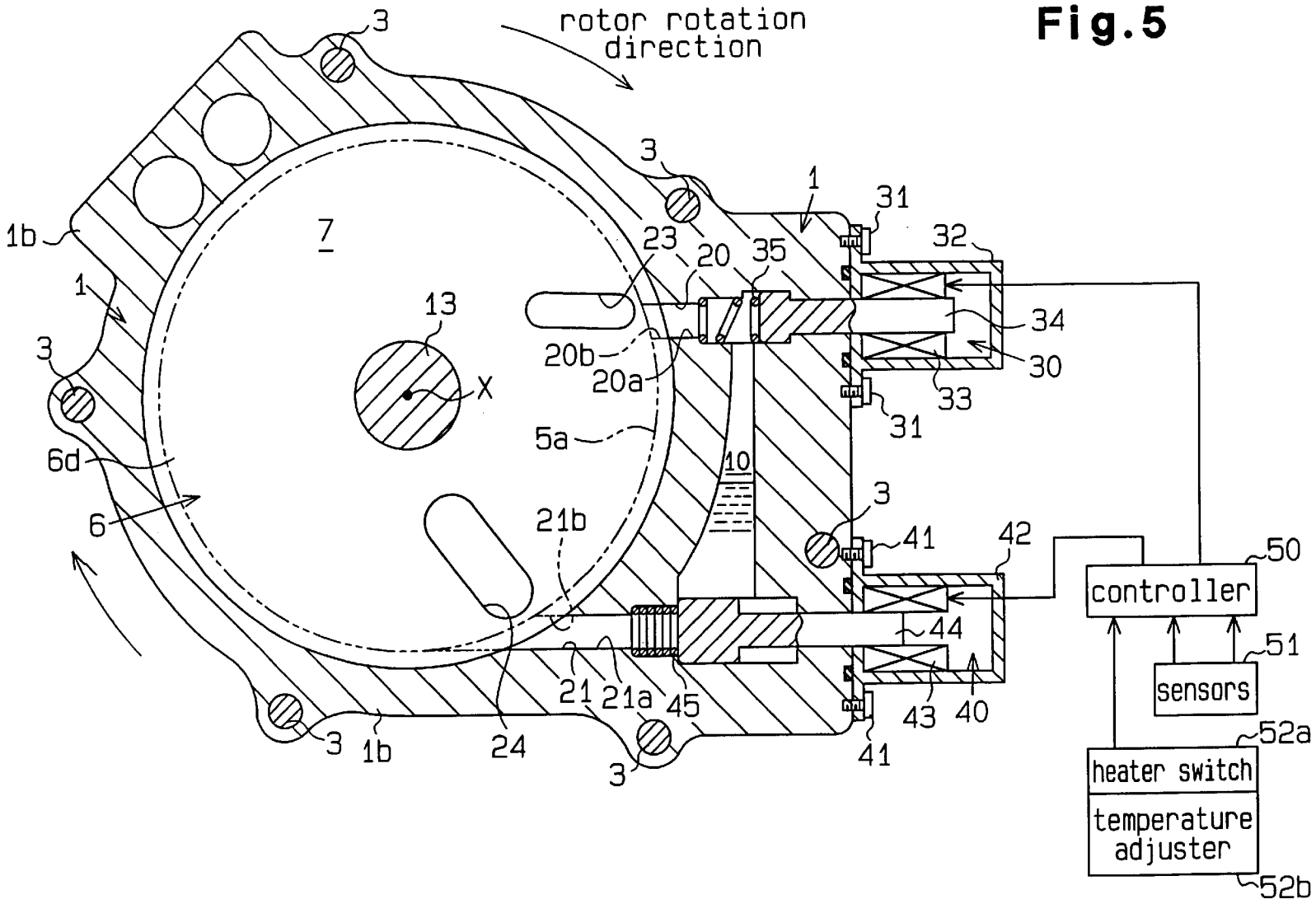
FIG. 5 is a cross-sectional view like FIG. 2 showing the return passage fully opened and the supply passage closed.
Figure 6:
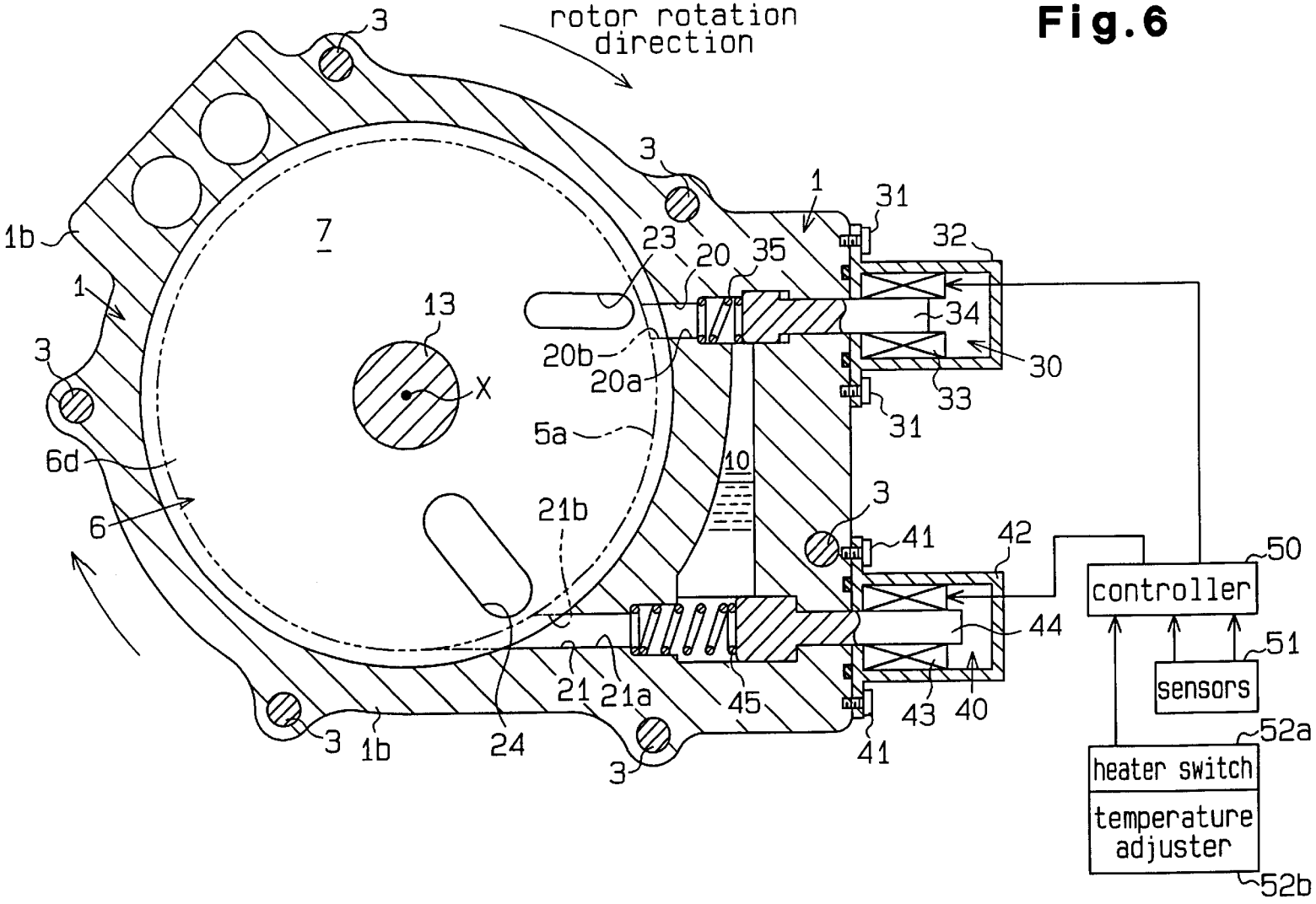
FIG. 6 is a cross-sectional view corresponding to FIG. 2 when the return passage is minimally opened and the supply passage is open.

As shown in FIGS. 2, 5 and 6, an upper electromagnetic solenoid 30 is attached to the front housing part 1. The upper solenoid 30 is accommodated in a case 32, which is attached to the outer surface of the front housing part 1 by bolts 31. The upper solenoid 30 includes an upper coil 33 and an upper plunger 34. The upper plunger 34 slides in the housing part 1, and the head of the upper plunger 34 is located in the upper chamber 10*a* of the reservoir chamber 10. Further, the head of the upper plunger 34 faces the exit of the return passage 20 in the reservoir chamber 10. The diameter of the head of the upper plunger 34 is larger than that of the exit of the return passage 20. As the upper plunger approaches the return passage 20, the exit opening of the return passage 20 becomes smaller. The upper plunger 34 moves between a position for maximizing the exit opening (See FIG. 5) and a position for minimizing the exit opening (See FIG. 6). An upper coil spring 35 is located between the head of the upper plunger 34 and a step of the return passage 20. The upper coil spring 35 urges the upper plunger 34 to move away from the return passage 20.

A lower electromagnetic solenoid 40 is accommodated in a case 42, which is attached to the outer surface of the front housing part 1 by bolts 41. The lower solenoid 40 includes a lower coil 43 and a lower plunger 44. The lower plunger 44 slides in the front housing part 1, and the head of the lower plunger 44 is located in the lower chamber 10*b* of the reservoir chamber 10. The head of the lower plunger 44 faces the entrance of the supply passage 21. The diameter of the head of the lower plunger 44 is larger than that of the entrance of the supply passage 21. A lower coil spring 45 is located between the head of the lower plunger 44 and a step of the supply passage 21. The lower coil spring 45 urges the lower plunger 44 to move away from the supply passage 21. The lower plunger 44 moves between a position for closing the entrance opening of the supply passage 21 (See FIG. 5) and a position for maximizing the entrance opening of the supply passage 21. As shown in FIG. 6, the entrance opening of the supply passage 21 when the lower plunger 44 is at the maximum opening position is greater than the exit opening of the return passage 20 when the upper plunger 34 is at the minimum opening position.

As shown in FIG. 2, a controller 50 is connected to the heater. The controller 50 may be built into the heater. The controller 50 controls the flow of the viscous fluid between the heating chamber and the reservoir 10, thus controlling the remaining amount of the viscous fluid in the heating chamber 7. When the controller is provided separately from the heater, an electronic control unit (ECU) of the engine E may include the function of the controller 50.

The controller 50 is, for example, a microcomputer, which includes a CPU, a ROM, a RAM and input-output interfaces (none is shown). The ROM stores a control program in advance. Various sensors 51 are connected to the controller 50. The sensors include a sensor for detecting the temperature of the passenger compartment or the atmosphere, a coolant temperature sensor, an engine speed sensor and a sensor for detecting the temperature of the viscous fluid. The controller 50 is connected to at least one of the above sensors.

The sensors 51 send temperature data and engine speed data as analog or digital detection signals. The controller inputs the detection signals from the sensors 51. ON/OFF instructions and set information for target temperature are input to the controller 50 through a heater switch 52*a* and a temperature adjuster 52*b*, which are located in the passenger compartment. The controller 50 is connected to the upper and lower coils 33, 43 and controls the supply of electric current to each coil 33, 43 based on a control program.

Operation of the heater will now be described.

When the engine E is stopped, the controller 50 does not supply electric current to the coils 33, 43. Then, the plungers 34, 44 are positioned as shown by FIG. 2 by the coil springs 35, 45. In this case, most of the silicone oil is divided between the lower chamber 10*b* of the reservoir 10 and the heating chamber 7. The total amount of silicone oil is predetermined to substantially fill the lower chamber 10*b* of the reservoir 10. Further, the lower chamber 10*b* is located below the axis X of the drive shaft 13. Accordingly, the surface level of the silicone oil of the heating chamber 7 is below the axis X.

When the starter motor 18 starts the engine E, the pulley 16, the drive shaft 13 and the rotor 14 starts rotating. The controller immediately supplies electric current to the lower coil 43. Accordingly, as shown in FIG. 5, the lower plunger 44 moves to close the supply passage 21 against the force of the lower coil spring 45. Then, the silicone oil of the heating chamber 7 flows into the return passage 20 guided by the return groove 23 and then into the reservoir 10, where it remains. Accordingly, the silicone oil in the heating chamber 7 quickly decreases for a short time after the engine starts, and the rotor 14 rotates with little resistance from viscous fluid. This quickly reduces the torque load applied to the engine E.

After the engine E is started, the controller 50 also supplies electric current to the upper coil 33. Accordingly, the upper plunger 34 moves to minimize the opening of the return passage 20. When the heater switch 52*a* is turned off, the current supply to the coils 33, 43 is maintained. Accordingly, the space between the surfaces of the rotor 14 and the inner walls of the heating chamber 7 is not filled with silicone oil, and heat is not produced.

When the heater switch 52*a* is turned on during the operation of the engine E, the controller 50 stops the current supply to the lower coil 43. Accordingly, as shown in FIG. 6, the lower plunger 44 moves to open the supply passage 21 under the force of the lower coil spring 45. This causes the silicone oil in the lower chamber 10*b* of the reservoir 10 to flow to the heating chamber 7 through the supply passage 21. The rotation of the rotor 14 guides the flow of the silicone oil from the reservoir 10 to the heating chamber 7. The supply groove 24 serves to facilitate the flow of the silicone oil. Accordingly, the space between the surfaces of the rotor 14 and the inner surfaces of the heating chamber 7 is quickly filled with silicone oil.

The silicone oil in the heating chamber 7 generates heat when sheared by the rotor 4. The heat generated in the heating chamber 7 is transferred to the coolant flowing in the water jackets 8, 9. Then, the coolant is supplied to a heating circuit (not shown) for heating the passenger compartment.

When the rotation of the rotor 14 is maintained by the drive force of the engine E and the heater switch 52*a* is on, the controller 50 controls the supply of the electric current to the lower coil 43 based on the signals from the sensors 51, so that the temperature of the passenger compartment will seek a target temperature set by the temperature adjuster 52*b*.

For example, when the temperature of the passenger compartment is lower than the target temperature, as shown in FIG. 6, the controller 50 stops the supply of the current to the lower coil 43 and opens the supply passage 21. In this state, electric current is being supplied to the upper coil 33, and the upper plunger 34 minimally opens the return passage 20. As already mentioned, in this state, the opening of the supply passage 21 is larger than that of the return passage 20. Accordingly, the supply of oil to the heating chamber is greater than the return of oil to the reservoir chamber 10. Therefore, the amount of oil in the heating chamber 7 gradually increases and the space between the surfaces of the rotor 14 and the inner surfaces of the heating chamber 7 is filled with silicone oil. As a result, the oil shearing capacity of the rotor 14 increases and heat generation increases.

On the other hand, when the temperature of the passenger compartment is above the target temperature, the controller supplies electric current to the lower coil 43. Then, the lower plunger 44 moves to close the supply passage 21. Accordingly, the supply of oil from the reservoir 10 to the heating chamber 7 is stopped and the return of oil is permitted through the return passage 20. Therefore, the amount of oil in the heating chamber 7 gradually decreases and the heat generated by shearing oil decreases. In this way, opening and closing the supply passage 21 by the lower plunger 44 controls the amount of heat generated.

When the heater switch 52 is turned off during the operation of the engine E, the controller 50 supplies current to the lower coil 43 to close the supply passage 21 with the lower plunger 44. Accordingly, most of the oil of the heating chamber 7 is returned to the reservoir 10 through the return passage 20 and heat generation is stopped.

When the engine E stops, the pulley 16, the drive shaft 13 and the rotor 14 also stop. When the heater switch is on while the engine E is stopped, the controller 50 stops the supply of current to the lower coil 43. Then, the lower plunger 44 moves to open the supply passage 21 by the lower coil spring 45. Some of the silicone oil of the heating chamber 7 flows to the lower chamber 10*b* of the reservoir 10 through the supply passage 21. Accordingly, the surface level of the oil of the heating chamber 7 is the same as that of the lower chamber 10*b* and is lower than the axis X.

When the engine E is restarted, as already described, the supply passage 21 is closed and the oil remaining in the heating chamber 7 is returned to the reservoir chamber 10 shortly after the rotor 14 starts rotating. Therefore, the torque resistance for starting the drive shaft 13 and the rotor 14 quickly decreases.

The vehicle heater according to the present embodiment has the following advantages.

When the engine E is stopped, some of the silicone oil in the heating chamber 7 flows to the lower chamber 10*b* of the reservoir 10 through the supply passage 21. The total amount of the silicone oil is determined to fill the lower chamber 10*b*. The volume of the lower chamber 10*b* is greater than that of the upper chamber 10*a* and reserves enough silicone oil. Further, the lower chamber 10*b* is located below the axis X of the drive shaft 13. Accordingly, when the engine E stops, the surface level of the oil in the heating chamber 7 is lower than the axis X of the drive shaft 13. This minimizes the contact area between the surface of the rotor 14 and the silicone oil when the rotor 14 stops. Accordingly, the resistance of the remaining oil on the rotor 14 is small when the rotor 14 restarts. Further, when the rotor restarts, since the supply passage 21 is closed and the oil in the heating chamber 7 is returned to the reservoir 10 through the return passage 20, the oil in the heating chamber 7 is further reduced and the resistance on the rotor 14 is reduced. As a result, the torque load for starting the pulley 16, the drive shaft 13 and the rotor is quickly reduced. Accordingly, when the engine is restarted, excessive shock and wear of parts are avoided.

Hypothetically, if a reservoir that has the same volume as the reservoir 10 of the present embodiment and that is uniformly shaped in both the upper and lower parts is formed, it is possible for the silicone oil of the heating chamber 7 to flow to the reservoir 10 through the supply passage 21. However, if the same amount of oil is used in the hypothetical heater as is used in the present embodiment, the surface level of oil in the heating chamber 7 will be higher than that of the present embodiment since the volume of the lower portion of the reservoir will be smaller. As a result, the contact area between the surface of the rotor 14 and the silicone oil would be greater. To make the contact area small, the total amount of oil must be reduced. However, if the total amount of oil is reduced, oil deterioration will occur earlier. The amount of oil used in the present embodiment is large enough to prevent early oil deterioration.

The lower chamber 10*b* of the reservoir 10 is enlarged in the axial direction of the drive shaft 13 to increase its volume. If the lower chamber 10*b* is enlarged in a direction perpendicular to the axis X, the heater housing must be enlarged in the radial direction of the drive shaft. When the lower chamber 10*b* is enlarged axially, there is no need to radially enlarge the heater housing. Therefore, the heater housing is radially compact and yet the lower chamber 10*b* has a large volume.

The upper chamber 10*a* of the reservoir 10 is not for reserving oil but simply for guiding oil from the return passage 20 to the lower chamber 10*b*. For this reason, the upper chamber 10*a* is narrow. Accordingly, the volume of the upper chamber 10*a* is small and the amount of air inside is small. This minimizes the amount of air in the sealed space of the reservoir chamber 10 and the heating chamber 7. This prevents early deterioration of silicone oil resulting from oxidization in the sealed space, and the life of the oil is extended.

The present invention can further be embodied as follows.

Figure 7:
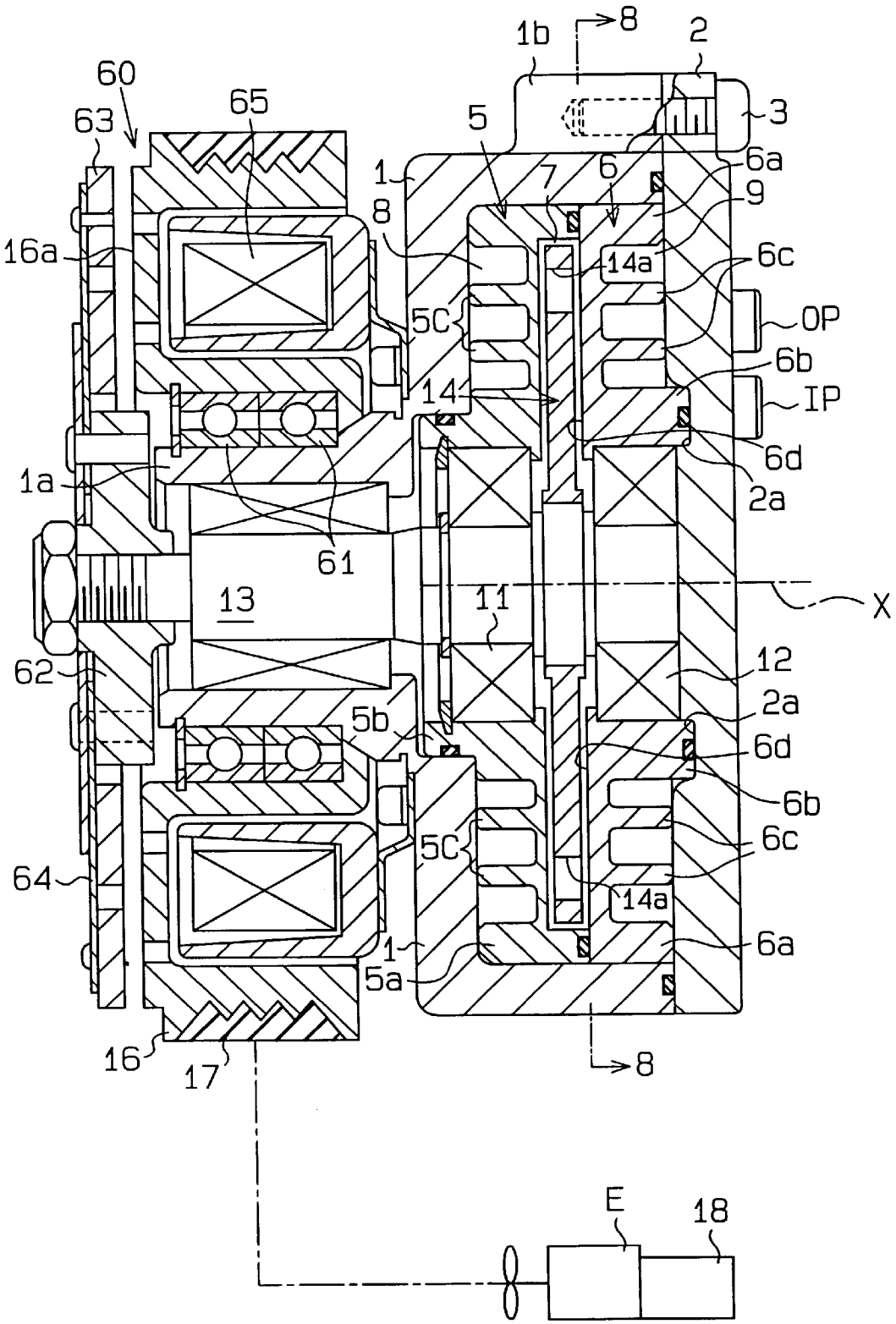
FIG. 7 is a cross-sectional view of a vehicle heater according to a second embodiment of the of the present invention.
Figure 8:
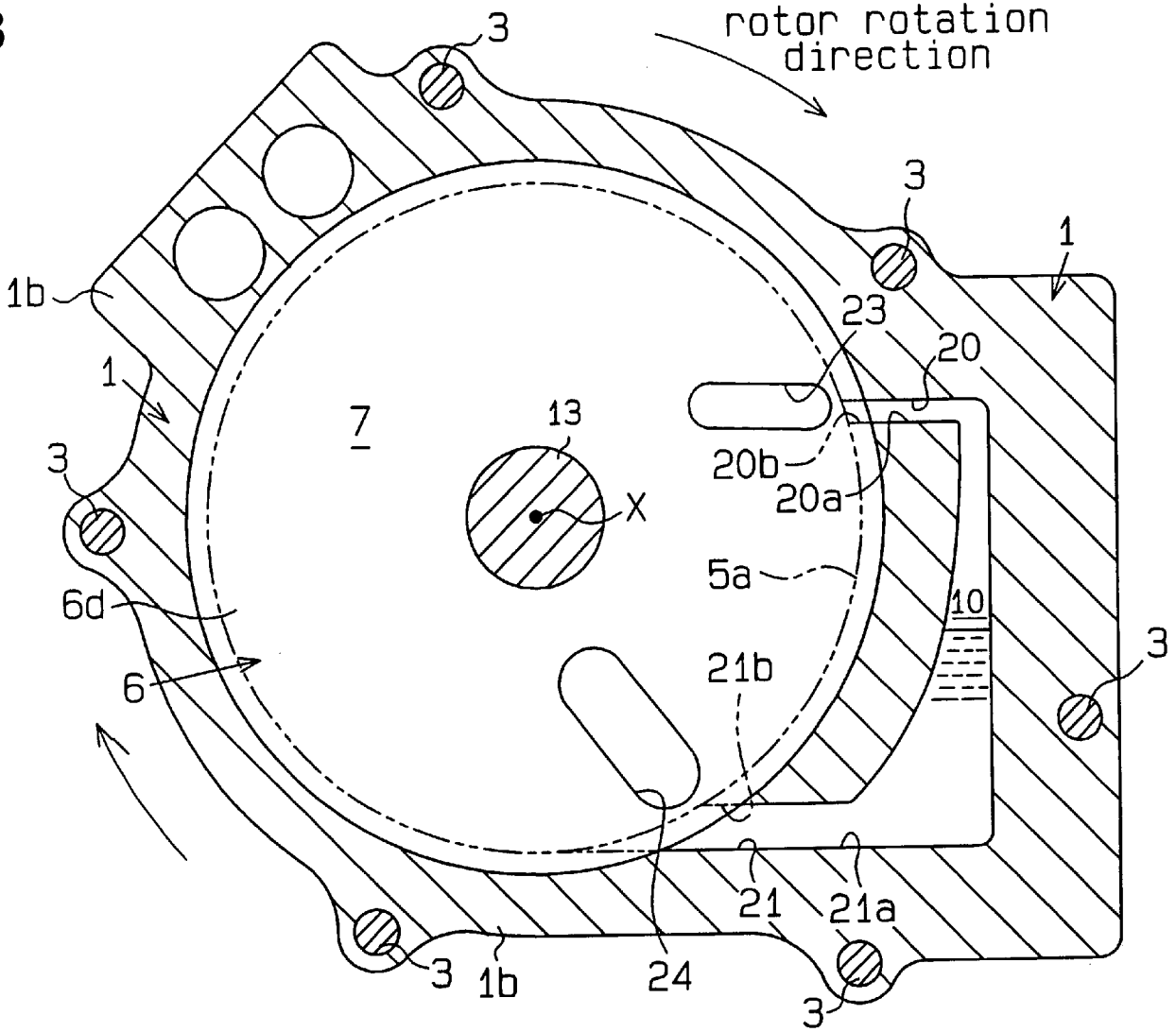
FIG. 8 is a cross-sectional view taken on line 8—8 of FIG. 7.
Figure 9:
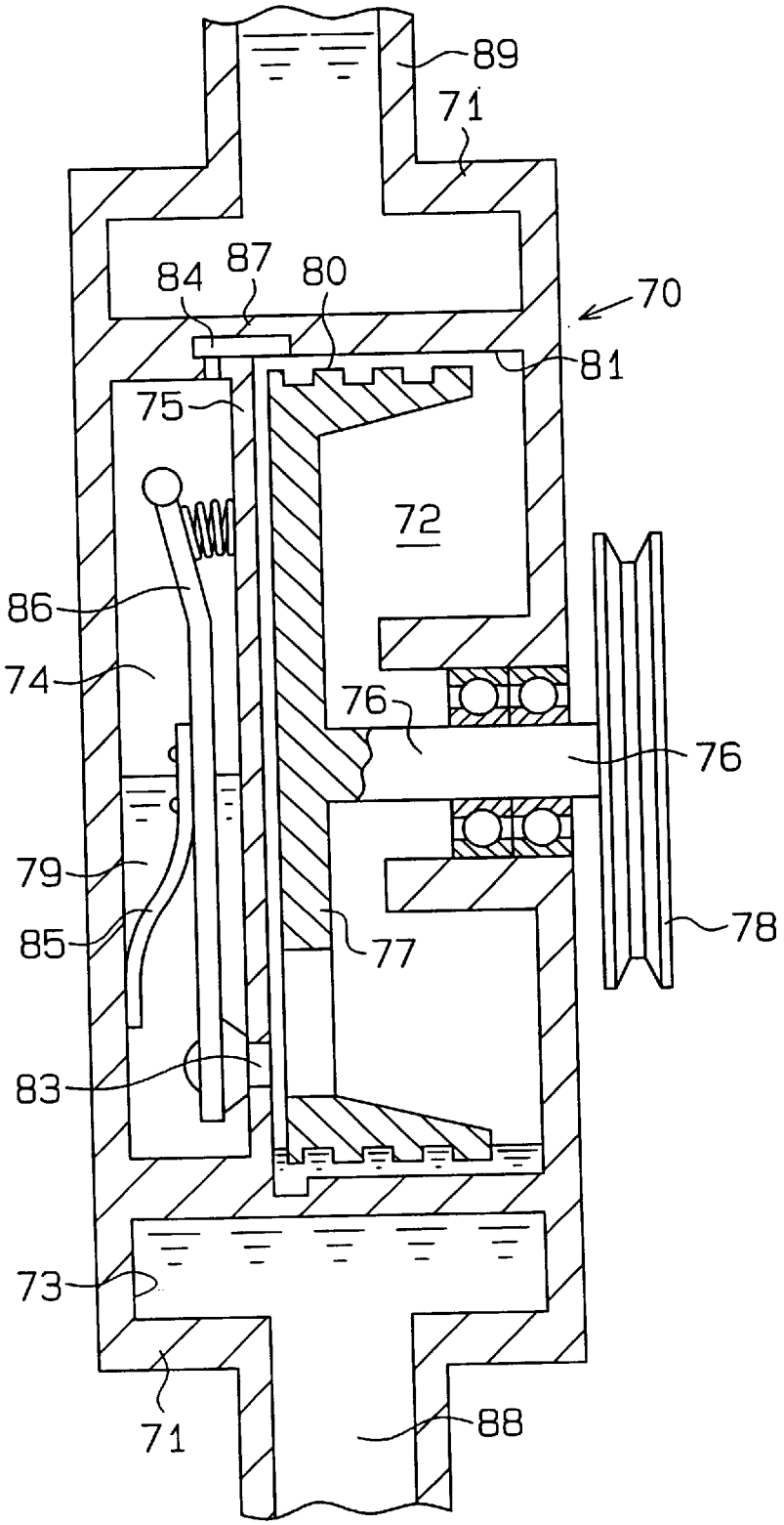
Fig.9(Prior Art)
FIG. 9 is a cross-sectional view of a prior art heater.

In a second embodiment of FIGS. 7 and 8, an electromagnetic clutch may be employed between the pulley 16 and the drive shaft 13 and the driving force of the engine E may be selectively transmitted when required. As shown in FIG. 7, the electromagnetic clutch 60 includes a pulley 16, support plate 62 and a clutch plate 63. The pulley 16 is rotatably supported on a boss 1*a* of the front housing part 1 through a pair of angular bearings 61. The support plate 62 is attached to the outer end of the drive shaft 13. The clutch plate 63 is joined to the support plate 62 by a plate spring 64. The clutch plate 63 faces a front surface 16*a* of the pulley 16.

The pulley 16 is connected to the engine E by a belt 17. The pulley 16 surrounds an annular solenoid coil 65. The solenoid oil 65 is attached to the front housing part 1. The solenoid coil 65 faces the clutch plate 63 with the pulley 16 in between.

As shown in FIG. 8, the upper and lower solenoids 30, 40 of the upper embodiment are omitted. Accordingly, the return passage and the supply passage are always open. The reservoir 10 of the second embodiment includes the same upper chamber 10*a* and the lower chamber 10*b* as employed in the first embodiment.

In the second embodiment, when the engine E operates, the driving force of the engine is transmitted to the pulley 16 through the belt 17. When the solenoid coil 65 of the electromagnetic clutch 60 is excited during the engine operation, the clutch plate is connected to the front surface 16*a* of the pulley 16 by the electromagnetic force, which acts against the force of the plate spring 64. Then, the rotation of the pulley 16 is transmitted to the drive shaft 13 through the clutch plate 63 and the support plate 62, thus rotating the rotor 14.

When the electromagnetic clutch 60 is off and the rotor 14 is stopped, the surface level of the silicone oil in the heating chamber 7 is low. This decreases the contact area between the surface of the rotor 14 and the silicone oil and quickly relieves the resistance of silicone oil on the rotor 14. Accordingly, when the electromagnetic clutch is turned on, an excessive shock is avoided. Further, since the transmission of the driving force to the rotor 14 is selectively cut off, the shearing of the silicone oil can be controlled. This prevents oil deterioration caused by excessive heating.

In the embodiment of FIG. 1 through FIG. 6, the lower plunger 44 may be reciprocated rapidly in a pumping movement for a certain time after the supply passage 21 is opened. In other words, the supply of electric current to the lower coil 43 may be started and stopped repeatedly. In this way, the lower plunger 44 moves reciprocally several times as predetermined by the control program of the controller 50. The reciprocation of the lower plunger positively sends the silicone oil of the lower chamber 10*b* of the reservoir 10 to the heating chamber 7 through the supply passage 21. Accordingly, the flow of oil from the reservoir 10 to the heating chamber 7 is speeded up.

Instead of using the electromagnetic solenoid 30, 40, the plungers 33, 44 may be driven hydraulically or pneumatically.

Further, the viscous fluid that can be used for the heater of the present invention is not limited to the silicone oil. Any viscous fluid can be used as long as it generates heat based on fluid friction by the shearing of the rotor 14.

Therefore, the present examples and embodiments are to be considered as illustrative and not restrictive and the invention is not to be limited to the details given herein, but may be modified within the scope and equivalence of the appended claims.

What is claimed is:

1. A heater comprising:

a heating chamber for accommodating a viscous fluid;

a rotor located in the heating chamber, wherein the rotor rotates and shears the viscous fluid to generate heat;

a heat exchanger, wherein the heat generated in the heating chamber is transferred to the heat exchanger and heats a fluid that flows through the heat exchanger;

a reservoir for storing the viscous fluid, wherein the reservoir has an upper portion and a lower portion, and the lower portion has a greater volume than the upper portion;

a return passage for connecting the heating chamber to the reservoir so that the viscous fluid moves from the heating chamber to the reservoir when the rotor rotates; and a supply passage for connecting the reservoir to the heating chamber so that the viscous fluid flows from the reservoir to the heating chamber.

2. The heater according to claim 1, wherein the lower portion and the supply passage are located below the axis of the rotor.

3. The heater according to claim 2, wherein the total amount of the viscous fluid substantially fills the lower portion.

4. The heater according to claim 1, wherein the reservoir is spaced from the heating chamber in the radial direction of the rotor.

5. The heater according to claim 1, wherein the lower portion is wider than the upper portion in the axial direction of the rotor.

6. The heater according to claim 1, wherein the supply passage connects the lower portion to the heating chamber, and the return passage connects the heating chamber to the upper portion.

7. The heater according to claim 6, wherein the upper portion includes a passage that extends in substantially vertical direction for connecting the return passage to the lower portion.

8. The heater according to claim 1 further including a valve mechanism for selectively opening and closing the supply passage.

9. The heater according to claim 8, wherein an external drive source rotates the rotor, and wherein the heater further comprises a controller for controlling the valve mechanism, wherein the controller causes the valve mechanism to open the supply passage when the external drive source is stopped and to close the supply passage when the external drive source is being started.

10. The heater according to claim 1 further including a guide channel formed in a wall of the heating chamber for guiding the viscous fluid from the supply passage to the heating chamber and another guide channel formed in the heating chamber wall for guiding the viscous fluid from the heating chamber to the return passage.

11. A heater installed in a vehicle and driven by the vehicle engine, the heater comprising:

a heating chamber for accommodating the viscous fluid;

a rotor located in the heating chamber to be driven by the engine, wherein the rotor rotates and shears the viscous fluid to generate heat;

a heat exchanger located adjacent to the heating chamber, wherein the heat generated in the heating chamber is transferred to the heat exchanger and heats a fluid flowing through the heat exchanger;

a reservoir for storing the viscous fluid, wherein the reservoir includes an upper portion and a lower portion, wherein the lower portion has a volume greater than that of the upper portion;

a supply passage for connecting the lower portion to the heating chamber to permit viscous fluid to flow between the heating chamber and the reservoir, wherein the lower portion and the supply passage are located below the axis of the rotor; and a return passage for connecting the heating chamber to the upper portion so that the viscous fluid can flow from the heating chamber to the reservoir when the rotor rotates.

12. The heater according to claim 11, wherein the reservoir is spaced from the heating chamber in the radial direction of the rotor.

13. The heater according to claim 11, wherein the lower portion is wider than the upper portion in the axial direction of the rotor.

14. The heater according to claim 11, wherein the upper portion includes a passage that extends in substantially vertical direction for connecting the return passage to the lower portion.

15. The heater according to claim 11 further including a valve mechanism for selectively opening and closing the supply passage.

16. The heater according to claim 15 further including a controller for controlling the valve mechanism, wherein the controller causes the valve mechanism to open the supply passage when the engine is stopped and to close the supply passage when the engine is being started.

17. The heater according to claim 11 further including a guide channel formed in a wall of the heating chamber for guiding the viscous fluid from the supply passage to the heating chamber and another guide channel formed in the heating chamber wall for guiding the viscous fluid from the heating chamber to the return passage.

18. The heater according to claim 11, wherein a clutch is located between the engine and the rotor so that the drive force of the engine is selectively transmitted to the rotor.

* * * * *